US010933432B2

(12) United States Patent
Ekström

(10) Patent No.: US 10,933,432 B2
(45) Date of Patent: Mar. 2, 2021

(54) CENTRIFUGAL SEPARATOR WITH BOWL HOOD DISMOUNTABLE VIA PRESSURE MEDIA

(71) Applicant: ALFA LAVAL CORPORATE AB, Lund (SE)

(72) Inventor: Anders Ekström, Täby (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 16/309,818

(22) PCT Filed: Jun. 8, 2017

(86) PCT No.: PCT/EP2017/063903

§ 371 (c)(1),
(2) Date: Dec. 13, 2018

(87) PCT Pub. No.: WO2017/216018

PCT Pub. Date: Dec. 21, 2017

(65) Prior Publication Data

US 2019/0358651 A1 Nov. 28, 2019

(30) Foreign Application Priority Data

Jun. 14, 2016 (EP) ..... 16174369

(51) Int. Cl.
*B04B 7/08* (2006.01)
*B04B 11/04* (2006.01)

(52) U.S. Cl.
CPC ..... *B04B 7/08* (2013.01); *B04B 11/04* (2013.01)

(58) Field of Classification Search
CPC .. B04B 11/04; B04B 1/10; B04B 1/16; B04B 1/18; B04B 7/08; B04B 1/14
See application file for complete search history.

(56) References Cited

U.S. PATENT DOCUMENTS 3,244,363 A * 4/1966 Hein ..... B04B 11/04 494/1
3,550,843 A * 12/1970 Hoffmann ..... B04B 1/18 494/27

(Continued)

FOREIGN PATENT DOCUMENTS

CN 1343139 A 4/2002
CN 202392110 U 8/2012

(Continued)

OTHER PUBLICATIONS

International Search Report, issued in PCT/EP2017/063903, dated Aug. 28, 2017.

(Continued)

*Primary Examiner* — Charles Cooley
(74) *Attorney, Agent, or Firm* — Birch, Stewart, Kolasch & Birch, LLP

(57) ABSTRACT

A centrifugal separator for separation of at least two components of a fluid mixture which are of different densities. The centrifugal separator includes a rotor rotatable about an axis of rotation and including a rotor wall which surrounds an inner space with a separating chamber within the rotor. The rotor wall is divided into an upper bowl hood, with an end portion, and a lower bowl body which are dismountably attached to each other. The centrifugal separator further includes an inlet for feeding the fluid mixture into the rotor's separating chamber, at least one outlet for discharging out from the rotor component separated from the fluid mixture, and a rotor shaft attached to the rotor and drivably connected to a motor for rotation of the rotor about the axis of rotation. The bowl hood and the bowl body are dismountably attached to each other by an annular flange portion of the bowl hood resting on a stop flange of the bowl body. The rotor includes a pressure media supply port for supplying pressure media to a space between the annular flange (Continued)

portion, having a lower free end surface, and the stop flange when dismounting the bowl hood from the bowl body where the pressure media is acting on the lower free end surface for displacing the bowl hood upwards out of the attachment from the stop flange.

20 Claims, 1 Drawing Sheet

(56) References Cited

U.S. PATENT DOCUMENTS

| | | | | |
|---|---|---|---|---|
| 4,059,223 | A | 11/1977 | Lewis | |
| 4,284,233 | A * | 8/1981 | Kulker | B04B 1/14 494/27 |
| 4,710,160 | A * | 12/1987 | Klintenstedt | B04B 7/08 494/64 |
| 4,717,376 | A * | 1/1988 | Bruning | B04B 1/14 494/29 |
| 6,432,034 | B1 * | 8/2002 | Hedin | B04B 1/14 494/85 |
| 6,676,131 | B1 * | 1/2004 | Hedin | B04B 1/14 277/358 |
| 7,331,919 | B2 * | 2/2008 | Niemerg | B04B 1/10 494/39 |
| 7,396,324 | B2 | 7/2008 | Tetsu et al. | |
| 7,749,148 | B2 * | 7/2010 | Mackel | B04B 7/08 494/70 |
| 9,005,097 | B2 | 4/2015 | Feng et al. | |
| 2004/0178127 | A1 * | 9/2004 | Niemerg | B04B 1/10 209/1 |
| 2012/0138519 | A1 | 6/2012 | Hagqvist et al. | |
| 2016/0184836 | A1 | 6/2016 | Mackel | |

FOREIGN PATENT DOCUMENTS

| | | | | |
|---|---|---|---|---|
| CN | 103821832 | A | 5/2014 | |
| CN | 104411411 | A | 3/2015 | |
| CN | 105121024 | A | 12/2015 | |
| DE | 10 2014 222 264 | A1 | 5/2015 | |
| EP | 1 214 151 | B1 | 6/2009 | |
| EP | 1214151 | B1 | 6/2009 | |
| EP | 2 774 684 | A1 | 9/2014 | |
| EP | 3257587 | A1 * | 12/2017 | B04B 7/08 |
| EP | 2774684 | B1 | 10/2018 | |

OTHER PUBLICATIONS

Written Opinion of the International Searching Authority, issued in PCT/EP2017/063903, dated Aug. 28, 2017.

* cited by examiner

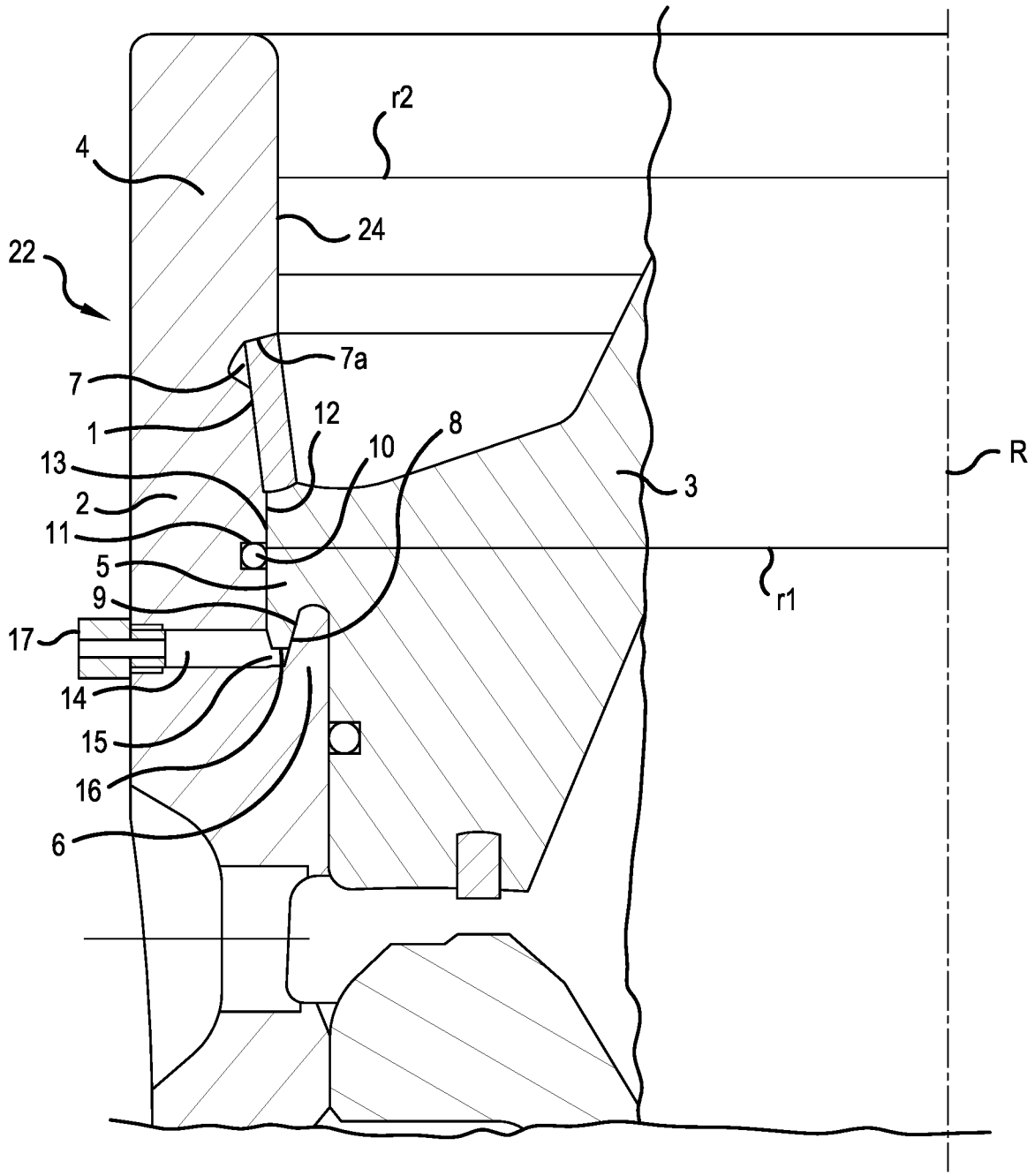
r2
4
24
22
7a
7
12
8
1
10
R
13
3
2
11
5
r1
9
17
14
15
16
6

CENTRIFUGAL SEPARATOR WITH BOWL HOOD DISMOUNTABLE VIA PRESSURE MEDIA

AREA OF INVENTION

The present invention generally relates to centrifugal separators, and is more specifically directed to the rotor and the mechanism whereby rotor parts are coupled together. More specifically it relates to a centrifugal separator for separation of at least two components of a fluid mixture which are of different densities.

The centrifugal separator comprises a rotor rotatable about an axis of rotation and comprising a rotor wall which surrounds an inner space with a separating chamber within the rotor, wherein said rotor wall is divided into an upper bowl hood and a lower bowl body which are dismountably attached to each other, an inlet for feeding the fluid mixture into the separating chamber of the rotor, at least one outlet for discharging out from the rotor a component separated from the fluid mixture, and a rotor shaft attached to the rotor and drivably connected to a motor for rotation of the rotor about the axis of rotation.

BACKGROUND OF INVENTION

Conventionally, the bowl hood and the bowl body are fixedly attached to each other by surfaces of the bowl hood and the bowl body, being in contact with each other. An example of this is disclosed in EP, B, 1214151. Here the bowl body has a circular cylindrical end portion, which has an inner radius and a center line, which coincides with the rotational axis. The bowl hood has an annular flange portion, which extends around the rotational axis in a plane perpendicular to the rotational axis. The flange portion has an outer radius, which is approximately as large as the inner radius of the circular cylindrical end portion, the flange portion being insertable in the end portion of the first part in one axial direction against a stop arranged in the rotor and is adapted to be lockable in the opposite axial direction by means of a locking joint comprising the locking ring.

When assembling the rotor, the locking ring is arranged to be brought radially outwardly from a position radially inside the inside of the circular cylindrical end portion and axially outside the annular flange portion into a recess extending around the rotational axis in the inside of the circular cylindrical end portion with a certain outer radius so that a radial outer portion of the locking ring extends out into a recess, whereas a remaining radial inner portion of the locking ring extends radially inside the outer radius of the flange portion and so that the outer portion of the locking ring abuts against the circular cylindrical end portion via two radially outer identical contact surfaces and so that the inner portion of the locking ring abuts against the flange portion via two radially inner identical contact surfaces. The contact surfaces are essentially rotationally symmetrical around the rotational axis and are adapted to transfer the axial forces due to the liquid pressure in the separation chamber on the second rotor part to the first rotor part.

The narrow gap of the contact zone between the contact surfaces is the source of a problem due to dirt entering and depositing there. The dirt causes problem when dismounting the bowl hood from the bowl body as it acts as a glue holding the two parts together.

DISCLOSURE OF INVENTION

The object of the present invention is thus to facilitate dismounting of the bowl hood from the bowl body.

The said bowl hood and said bowl body are dismountably attached to each other by an annular flange portion of said bowl hood resting on a stop flange of said bowl body. Said rotor comprises a pressure media supply port for supplying pressure media to a space between said annular flange portion, having a lower free end surface, and said stop flange when dismounting said bowl hood from said bowl body where said pressure media is acting on said lower free end surface for displacing said bowl hood upwards out of said attachment from said stop flange.

The pressure media supply port may be a through hole through said end portion with a first end outside said rotor and a second end in said space.

Said space may be a circumferential recess in the end portion.

The through hole may be threaded to be adapted to be fitted with a threaded nipple.

The cylindrical end portion may have a radially inner surface facing and in sealing contact with a radially outer surface of the annular flange portion.

The sealing contact may be effected by a sealing arranged in a cylindrical groove in said radially inner surface. The sealing is an O-ring.

The annular flange portion of the second part may have a radially inner surface which is inclined upwardly in an inwardly radial direction and resting on a radially outer surface of the stop flange which is also inclined upwardly in an inwardly radial direction.

BRIEF DESCRIPTION OF THE DRAWINGS

Further objects, features and advantages will appear from the following detailed description of several embodiments of the invention with reference to the figures on the attached drawings, in which:

The sole FIGURE shows a section through a part of a rotor of a centrifugal separator featuring an area around the contact surfaces of the bowl hood and the bowl body according to the invention.

DETAILED DESCRIPTION OF EMBODIMENTS

In the FIGURE, a part of a rotor, generally referred to by reference number 22, of a centrifugal separator is shown. The rotor 22 is rotatable around a rotational axis R and has a first part 2, which also called a bowl body and a second part 3, which also is called a bowl hood.

The first part 2 has a circular cylindrical end portion 4, the center line of which coincides with the rotational axis R. The second part 3 has an annular flange portion 5, which extends around the rotational axis R in a plane perpendicular to the rotational axis R.

The circular cylindrical end portion 4 of the first part 2 has an inner radius r2 larger than the outer radius r1 of the flange portion 5 so that the flange portion 5 is axially insertable into a first circumferential recess 15 of the end portion 4 against an annular stop flange 6 arranged in the first part 2 of the rotor 22. The flange portion 5 has a free lower end surface 16 in said first recess 15. The end portion 4 has an inside surface 24 which is designed with a second recess 7, which extends around the rotational axis R and has in this embodiment a radial outer conical contact surface 7*a* with a direction of normalcy, which is directed axially and inclined radially inwardly towards the rotational axis R.

The rotor is further provided with a locking ring 1. The locking ring 1 has a frusto-conical shape with a rectangular cross-section and extends essentially a complete revolution around the rotational axis R. The locking ring 1 is so formed in one single integrated piece by an elastically resilient material that it in unloaded condition tends to be essentially annular shaped with an outer radius which at least is as large as the outer radius of the recess 7 (see FIG. 1). Continuing with FIG. 1, the locking ring 1 is arranged to be able to be brought from a position radially inside the inside of the end portion 4 radially outwardly into the recess 7 when the second part 3 of the rotor has been brought axially towards the stop flange 6. The position of the locking ring 1 is such that it prevents any axial movement of the second part 3 in relation to the first part 2.

The annular flange portion 5 of the second part 3 has a radially inner surface 8 which may be inclined upwardly in an inwardly radial direction. This inner surface 8 is formed to rest on a radially outer surface 9 of the stop flange 6, which outer surface 9 thus also may be inclined upwardly in an inwardly radial direction. When mounted the flange portion 5 of the second part 3 thus rests on the stop flange 6 of the first part 2.

The radially inner surface 8 of the annular flange portion 5 of the second part 3 may instead be substantially vertical as may the radially outer surface 9 of the stop flange 6.

The cylindrical end portion 4 has a radially inner surface 13 which there is a cylindrical groove 11 in which a sealing 10, e.g. an O-ring is fitted. When the second part 3 is mounted in the first part 2, the inner surface 13 is facing and in sealing contact with a radially outer surface 12 of the annular flange portion 5. The sealing 10 reduces the risk of dirt entering the gaps between the first part 2 and the second part 3.

The bowl hood 3 and the bowl body 2 are thus dismountably attached to each other by the flange portion 5 of said bowl hood 3 resting on the stop flange 6 of said bowl body 2. The rotor 22 comprises a pressure media supply port 14 extending between an outer end at the outer surface of the bowl body and an inner end at the inner surface of the bowl body for supplying pressure media to a space 15 between said flange portion 5 and said stop flange 6 when dismounting said bowl hood 3 from said bowl body 2 by displacing the bowl hood 2 upwards out of attachment from said stop flange (6). The annular flange portion and the stop flange are at the inner end of the pressure media supply port and between the pressure media supply port and the separating chamber.

The cylindrical end portion 4 has a radial through hole 14 with a first end outside said rotor and a second end in the first recess 15, and functions as a fluid media supply port. If a locking ring 1 is mounted to lock the second part 2 against the first part 3 it has to be removed before dismounting of the second part 2. Thereafter, the through hole 14 may be connected to a pressure source, like a pump, for pumping in pressure media, which may be a fluid or grease into the first recess 15 in order to press against the lower end surface 16 of the flange portion 5. This force upon the second part 3 will cause it easily come loose and separate from the first part 2, since it works like a hydraulic cylinder-piston arrangement.

The through hole 14 may be fitted with a threaded grease nipple 17 to more easily be connected to said pressure source. The through hole 14 is then also likewise threaded. This nipple is then removed during operation and is also not present during mounting. During assembly of the centrifugal separator or in operation the radial through hole 14 may be open or more preferably equipped with a plug.

The invention is not limited to the embodiments described above and shown on the drawings, but can be supplemented and modified in any manner within the scope of the invention as defined by the enclosed claims.

The Invention claimed is:

1. A centrifugal separator for separation of at least two components of a fluid mixture which are of different densities, comprising:

a rotor rotatable about an axis of rotation and comprising a rotor wall which surrounds a separating chamber within the rotor, wherein said rotor wall is divided into an upper bowl hood, and a lower bowl body having an end portion which are dismountably attached to each other;

an inlet for feeding the fluid mixture into the separating chamber;

at least one outlet for discharging out from the rotor a component separated from the fluid mixture; and a rotor shaft attached to the rotor and drivably connected to a motor for rotation of the rotor about the axis of rotation, wherein said bowl hood and said bowl body are dismountably attached to each other by an annular flange portion of said bowl hood resting on a stop flange of said bowl body, wherein said bowl body comprises a pressure media supply port extending between an outer end at the outer surface of the bowl body and an inner end at the inner surface of the bowl body for supplying pressure media to a first space between said annular flange portion, having a lower free end surface, and said stop flange when dismounting said bowl hood from said bowl body, wherein the annular flange portion and the stop flange are at the inner end of the pressure media supply port, wherein the annular flange portion and the stop flange are between the pressure media supply port and the separating chamber, and wherein the pressure media supply port is in fluid communication with the lower free end surface of the annular flange portion so that said pressure media acts on said lower free end surface for displacing said bowl hood upwards out of said attachment from said stop flange.

2. The centrifugal separator according to claim 1, wherein said pressure media supply port is a through hole through said end portion with the outer end outside said rotor and the inner end in the first space.

3. The centrifugal separator according to claim 2, wherein said through hole is threaded to be adapted to be fitted with a threaded nipple.

4. The centrifugal separator according to claim 3, wherein the annular flange portion of the bowl hood has a radially inner surface which is substantially vertical.

5. The centrifugal separator according to claim 3, wherein a sealing contact between the bowl hood and the lower bowl body is effected by a sealing arranged in a cylindrical groove in a radially inner surface of the lower bowl body.

6. The centrifugal separator according to claim 5, wherein the annular flange portion of the bowl hood has a radially inner surface which is substantially vertical.

7. The centrifugal separator according to claim 5, wherein the sealing is an O-ring.

8. The centrifugal separator according to claim 2, wherein the first space is a circumferential recess in the end portion.

9. The centrifugal separator according to claim 2, wherein the end portion has a radially inner surface facing and in sealing contact with a radially outer surface of the annular flange portion.

10. The centrifugal separator according to claim 2, wherein the annular flange portion of the bowl hood has a radially inner surface which is substantially vertical.

11. The centrifugal separator according to claim 2, wherein the annular flange portion of the bowl hood has a radially inner surface which is inclined upwardly in an inwardly radial direction and resting on a radially outer surface of the stop flange that is inclined upwardly in an inwardly radial direction.

12. The centrifugal separator according to claim 1, wherein the first space is a circumferential recess in the end portion.

13. The centrifugal separator according to claim 12, wherein the end portion has a radially inner surface facing and in sealing contact with a radially outer surface of the annular flange portion.

14. The centrifugal separator according to claim 12, wherein the annular flange portion of the bowl hood has a radially inner surface which is substantially vertical.

15. The centrifugal separator according to claim 12, wherein the annular flange portion of the bowl hood has a radially inner surface which is inclined upwardly in an inwardly radial direction and resting on a radially outer surface of the stop flange that is inclined upwardly in an inwardly radial direction.

16. The centrifugal separator according to claim 1, wherein the end portion has a radially inner surface facing and in sealing contact with a radially outer surface of the annular flange portion.

17. The centrifugal separator according to claim 16, wherein the annular flange portion of the bowl hood has a radially inner surface which is substantially vertical.

18. The centrifugal separator according to claim 1, wherein the annular flange portion of the bowl hood has a radially outer surface which is substantially vertical.

19. The centrifugal separator according to claim 1, wherein the annular flange portion of the bowl hood has a radially inner surface which is inclined upwardly in an inwardly radial direction and resting on a radially outer surface of the stop flange that is inclined upwardly in an inwardly radial direction.

20. The centrifugal separator according to claim 1, wherein the pressure media supply port has the outer end in an exterior surface of the rotor and the inner end in the first space.

* * * * *